United States Patent [19]

Long

[11] Patent Number: 4,688,791

[45] Date of Patent: Aug. 25, 1987

[54] SWIMMING MOTION EXERCISER

[76] Inventor: Needham L. Long, 1303 Northampton Rd., Anderson, S.C. 29621

[21] Appl. No.: 932,931

[22] Filed: Nov. 19, 1986

Related U.S. Application Data

[63] Continuation of Ser. No. 715,342, Mar. 25, 1985, abandoned.

[51] Int. Cl.[4] ..... A63B 21/00

[52] U.S. Cl. ..... 272/73; 272/130

[58] Field of Search ..... 272/73, 130, 71, 116, 272/117; 128/25 R, 707; 434/254

[56] References Cited

U.S. PATENT DOCUMENTS

| | | | |
|---|---|---|---|
| 1,728,103 | 3/1928 | Chaligne | 128/25 R |
| 2,020,992 | 11/1935 | Caplan | 128/25 R |
| 3,213,852 | 10/1965 | Zent | 128/25 R |
| 3,991,749 | 11/1976 | Zent | 128/25 R |
| 4,249,725 | 2/1981 | Mattox | 272/130 |

FOREIGN PATENT DOCUMENTS

| | | | |
|---|---|---|---|
| 681070 | 2/1964 | Canada | 272/71 |
| 2818020 | 11/1979 | Fed. Rep. of Germany | 272/73 |
| 780716 | 5/1935 | France | 272/73 |
| 1500390 | 11/1967 | France | 125/25 R |

*Primary Examiner*—Richard J. Apley
*Assistant Examiner*—S. R. Crow
*Attorney, Agent, or Firm*—Julian W. Dority

[57] ABSTRACT

A device is described, the use of which results in total body exercise which closely mimics that derived from swimming. Upper and lower extremities and trunk are all exercised with the body in an upright, slightly forward-tilted posture, and totally supported by the user's arms and legs, in an outstretched posture somewhat simulating the free-style swimming position. In the embodiments shown, the resistance against which the user works consists of marine propellers mounted on a shaft immersed in a tank filled with viscous fluid. The motor force generated by the user's rotation of the hand and foot cranks on sprockets is mediated by drive chains to a common sprocket which energizes the propeller shaft in the liquid-filled tank. The constantly-maintained 90 degrees out-of-phase mutual positions of the hand operated versus the foot operated cranks prevent "pulsing" of the load/resistance, and thus simulate the smooth sensation of non-varying resistance as is experienced by swimming.

10 Claims, 3 Drawing Figures

SWIMMING MOTION EXERCISER

This is a continuation of application Ser. No. 06/715,342 entitled "Swimming Motion Exerciser" filed on Mar. 25, 1985 now abandoned.

BACKGROUND OF THE INVENTION

Total body exercise cannot be performed ideally in the sitting position because the torso of the person is largely immobilized. Most authorities on physical exercise agree that swimming is probably the best total body exercise for cardio-respiratory endurance and overall physical well-being. The invention herein described relates to an exerciser which allows the user to obtain total body exercise in a manner which simulates the motions experienced and the exercise derived from swimming.

Various types of exercise devices have long been known for providing healthful exercise. For example, U.S. Pat. No. 3,213,852 entitled "Exercising Apparatus" discloses a motorized exerciser which provides different rotative speeds between the hand crank arms and the feet crank arms. U.S. Pat. No. 4,071,235 entitled "Adjustable Resistance Exercising Apparatus" discloses a manual exerciser which provides a constantly varying relative rotatable displacement between the hand crank arms and feet crank arms. Additionally, U.S. Pat. No. 4,402,502 entitled "Exerciser For Disabled Persons" discloses an exerciser which allows a person sitting in a wheelchair to simultaneously exercise both his upper body and his lower body by providing rotating hand crank arms and feet crank arms. While these exercisers are suited to the stretching, flexing and relaxing of most of the muscles in the body, they are designed for a user who is in a seated position, and some are passive.

SUMMARY OF THE INVENTION

The present invention allows total body exercise by providing the user with a means by which he can exercise his body with movements which closely imitate the movements of swimming. The upper and lower extremities and the trunk are all exercised with the trunk in an upright, slightly forward-tilted position. The user is supported only by his arms and legs, and cannot be seated while using the present exerciser because the whole body must participate.

The user obtains a good workout more rapidly than in swimming because the resistance to movement provided by the present exerciser is grater than that of swimming. This is because the weight of the user must be supported only by his arms and legs while exercising, whereas in swimming, the buoyancy of water provides the weight-bearing support. As in actual swimming, the user's joints, especially the hips and knees, are spared the jarring trauma associated with running.

The present exerciser has a unique load/resistance mechanism best characterized by the word, "consistency". A tank filled with a viscous liquid houses the mechanism which produces the constant resistance to motion caused by the user's exertions, yet it does not allow any appreciable buildup of momentum in the system. So, when the user stops his/her movements, the viscous resistance mechanism quickly causes all moving parts to come to a standstill. Thus, this feature also provides a built-in safety function from potential bodily injury not present in momentum-type rotary wheel exercisers.

The present exerciser includes a frame to which foot-operated pedal arms and hand-operated crank arms are rotatably mounted. The foot pedal cranks and the hand cranks each carry a single sprocket. An intermediate sprocket is also on the frame between the foot pedal sprocket and the hand crank sprocket. Two chains connect the hand crank and foot pedal sprockets, respectively, to the intermediate sprocket which energizes the load/resistance mechanism in the fluid-filled resistance tank.

Of critical importance is the fact that the hand crank and foot pedal arms are ninety degrees out-of-phase with each other, and this relationship is maintained at all times. This ninety degree out-of-phase relationship between the hand crank arms and the foot pedal crank arms is responsible for the constancy of the load/resistance while operating the exercising device. It prevents "pulsing" of the load/resistance without the use of the "traditional" energy-storing flywheel, because torque produced by the user's legs is at a maximum when the torque from the arms is at a minimum, and vice versa.

Extending from the intermediate sprocket is an output shaft. Attached to one end of the output shaft is a right-angle gearbox. Extending downward vertically from the gearbox into the liquid-filled tank is a shaft mounted with two (the number could be greater or less) marine propellers. The tank contains the viscous fluid in which the shaft with the marine propellers is immersed. When the exerciser is in use, the user is simultaneously rotating both the hand and foot pedal cranks. These rotations are transmitted to the intermediate sprocket by means of the two chains. The intermediate sprocket, in turn, energizes the output shaft to rotate. The output shaft, through the gearbox, causes the propeller shaft to rotate within the viscous fluid in the tank. This rotation of the propeller shaft in the fluid in the tank churns the fluid, and thus produces the resistance which works against the efforts of the user. Stationary baffles within the fluid-filled tank minimize coincident rotation of the fluid which, if allowed to occur, would eliminate much of the desired resistance. Because the load/resistance operates through a liquid, the forces experienced during actual swimming are closely simulated by this exercise device.

In summary, it is an object of the present invention to:

(1) allow a user to benefit from total body exercise provided by a simulated swimming motion when using this exercising device, and (2) provide a device which offers uniform and sustained resistance to the user's motions similar to the forces experienced during actual swimming, and (3) provide a device which always keeps the respective axes of the rotary hand and foot cranks approximately ninety degrees out-of-phase with each other because this prevents pulsing of the load/resistance, and (4) provide an exerciser whereby the user is supported in air entirely by his/her arms and legs which causes greater physical stress and energy expenditure then swimming since the body is not supported by the buoyancy of water as when swimming, and (5) provide an exerciser which is adjustable so that it accommodates a wide variety of people of different sizes.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
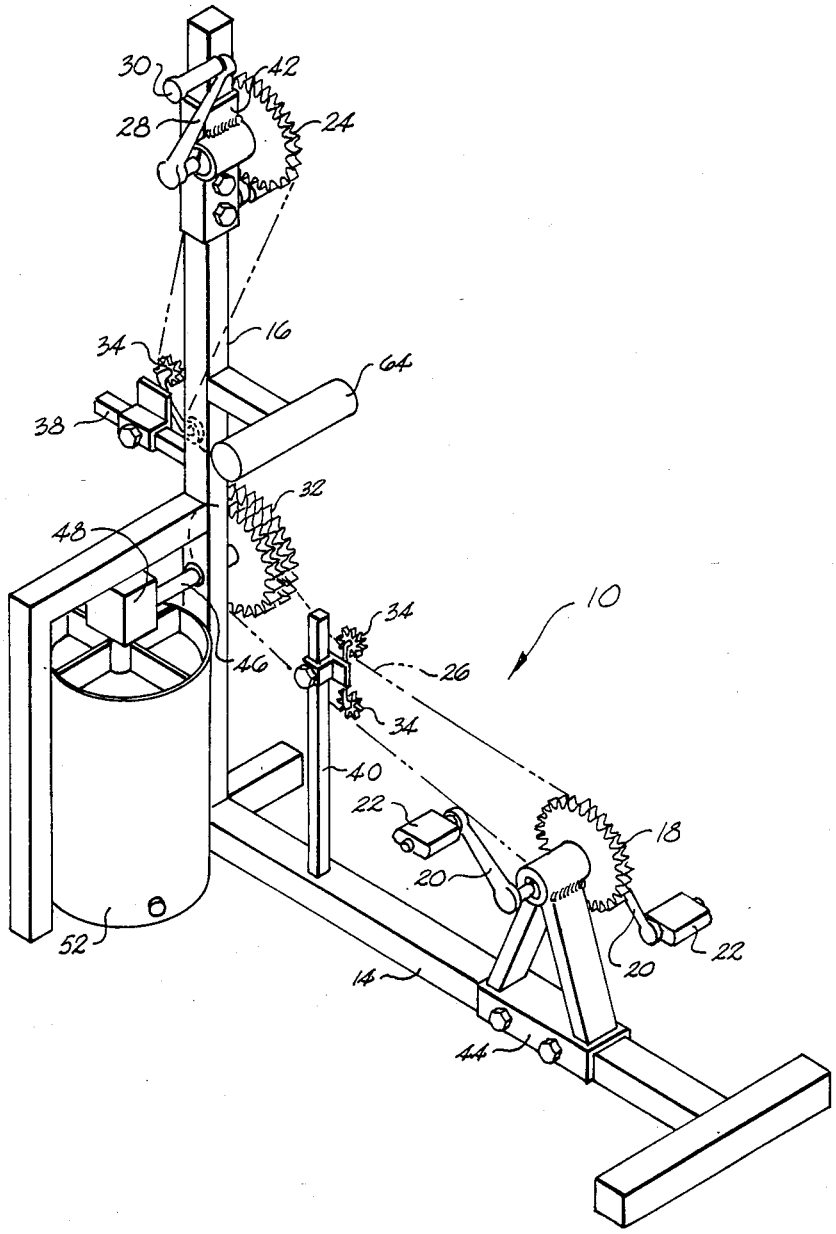
FIG. 1 is a perspective view illustrating an exerciser constructed in accordance with the present invention.

Referring to the drawings, the exerciser 10 is shown having a frame 12 which includes a base portion 14 and a vertical portion 16. Carried on the base portion 14 of the frame 12 is a foot pedal sprocket 18. Extending from the foot pedal sprocket 18 are two opposed pedal crank arms 20 having foot pedals 22 rotatably mounted thereon. The foot pedal sprocket 18 is mounted for rotation and communicates with a hand crank sprocket 24, which is rotatably mounted on vertical portion 16, by means of a connecting chain 26. The hand crank sprocket 24 has crank arms 28 extending from its center which carry at their ends handles 30.

An intermediate sprocket 32 is rotatably mounted beneath the hand crank sprocket 24 in the vertical portion 16 of the frame 12. The connecting chain 26 which transmits motive force from the foot pedal sprocket 18 and the hand crank sprocket 24 also is in communication with the intermediate sprocket 32, so that when any one of the sprockets 18, 24, 32 is rotated, all three of the sprockets 18, 24, and 32 will be rotated. Proper tensioning of the chain is accomplished through the use of idler sprockets 34 which are carried by collars 36 which are adjustable along horizontal and vertical supports 38, 40. Horizontal support 38 extends from vertical portion 16 of frame 12, and vertical support 40 extends upwardly from the base portion 14 of the frame 12.

The hand crank sprocket 24 is carried by a vertically adjustable bracket 42 which is movable along the vertical portion 16 of the frame 12. The foot pedal sprocket 18 is carried by a horizontally adjustable bracket 44 which is movable along the base portion 14 of the frame 12. The vertically adjustable bracket 42 and the horizontally adjustable bracket 44 allow for the distance between the foot pedal sprocket 18 and the hand crank sprocket 24 to be readily varied to thus accommodate a wide variety of people having differing heights.

An output shaft 46 is carried for rotation at one end by the intermediate sprocket 32 and is rotatably mounted in the vertical portion 16 of the frame 12. The output shaft 46 terminates at its end opposite that of the intermediate sprocket 32 into a gear reduction box 48. The gear reduction box 48 has rotatably mounted a propeller shaft 50 connected to it which extends from the gear reduction box 48 at a right angle to the output shaft 46. The propeller shaft 50 rotates within a cylindrical viscous resistance tank 52 which is carried adjacent the base portion 14 of the frame 12, shown in FIG. 2. The gear reduction box 48 is mounted on top of the viscous resistance tank 52.

Figure 3:
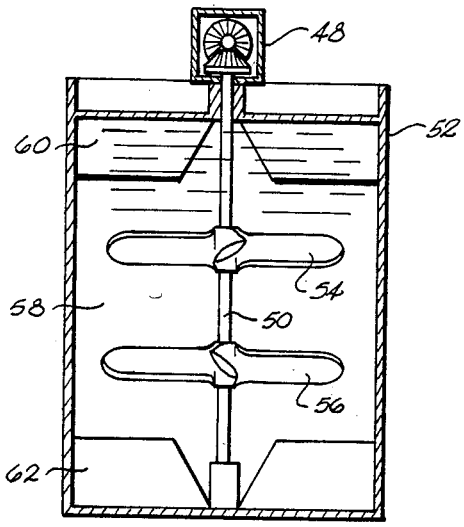
FIG. 3 is a sectional view showing the interior of the viscous resistance tank mechanism.

FIG. 3 illustrates the interior of the viscous resistance tank 52. Carried on the propeller shaft 50 are two propellers 54, 56. The propellers 54, 56 are of reverse pitch with respect to one another to churn the fluid 58 and thus inhibit the coincident motion of fluid 58 contained in the viscous resistance tank 52 in the direction of rotation of the propellers 52 as the propeller shaft 50 rotates due to the turning of the output shaft 46 of the intermediate sprocket 32 through the gear reduction box 48. Two vertically extending plate-like baffles 60, 62 are carried in the interior of the viscous resistance tank 52 and serve to further inhibit coincident motion of the fluid 58 as propeller shaft 50 turns. One of the baffles 60 is located adjacent the top inner surface of the viscous resistance tank 52, spaced above propeller 54. The other baffle 62 is located adjacent the bottom interior surface of the viscous resistance tank 52, spaced below propeller 56.

Figure 2:
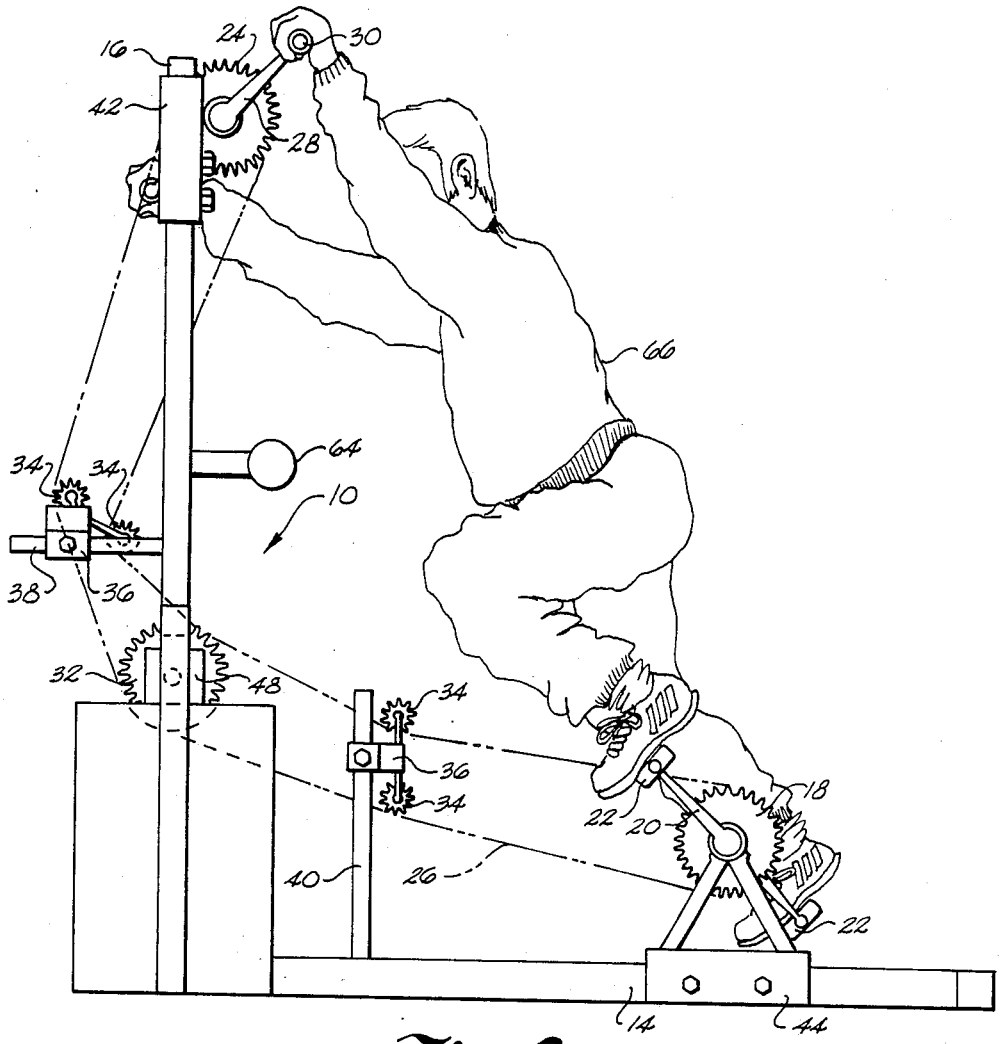
FIG. 2 is a side elevational view of the preferred embodiment shown in FIG. 1 with a user positioned thereon and shown in a typical exercising position.

A horizontally extending handle 64 is located on the vertical portion 16 of the frame 12 and extends upwardly therefrom towards the user 66 as shown in FIG. 2. The handle 64 aids the user 66 as he mounts and dismounts the exerciser 10. The handle 64 also serves as a safety feature in that should the user 66 lose his grip from the hand crank handles 30, he may grab the handle 64 to keep from falling off of the exerciser 10.

During operation of the exerciser 10, the user 66 places his feet on the foot pedals 22 and then, with the aid of the handle 64, places his hands on the hand crank handles 30. As can be seen from FIG. 2, the user 66 is in an outwardly stretched, forward tilting position. This outwardly stretched position simulates that position which is assumed when swimming.

The pedal crank arms 20 and the hand crank arms 28 are always kept substantially at a ninety degrees out-of-phase relationship to one another. This out-of-phase relationship prevents "pulsing" of the viscous resistance tank 52 even without an energy storing device such as a flywheel. The out-of-phase relationship between the pedal crank arms 20 and the hand crank arms 28 also allows for the torque produced by the legs of the user 66 to be at a minimum when the torque produced by the user 66's arms is at a maximum, and vice versa. This allows for a smooth swimming motion to be achieved when using the exerciser 10. Since the user 66 is not in a seated position when using the exerciser 10, he must exert additional energy to support himself which is not required when using typical exercise bicycles. Also, the normal buoyancy force exerted on a body when it is in water, is not present on the instant exerciser 10. Thus, the user 66 exercises the same muscles that would be exercised if he or she were to swim. However, with the exerciser 10 the user 66 will be fully exercised in a shorter amount of time than that which would be required for swimming.

As can be seen from FIG. 2, as the user 66 operates both the hand cranks and the pedal cranks, their motion is transmitted to the intermediate sprocket 32 by means of the connecting chain 26. The intermediate sprocket 32, in turn, turns the propeller shaft 50 by means of the output shaft 46 acting through the gear reduction box 48. The propeller shaft 50 causes the propellers 54, 56 to spin in the fluid 58 of the viscous resistance tank 52. The fluid 58 offers resistance to the motion of the propellers 54, 56 and thus forces the user 66 to have to work to actually turn the propellers 54, 56 in the fluid 58. The fluid resistance against the propellers 54, 56 produces a smooth nearly, inertialess feel which makes for a desirable load against which the user 66 must work.

The amount of resistance against which the user 66 must work in operating the exerciser 10 can be varied by changing the fluid 58 to that having a different viscosity, or an adjustable braking mechanism (not shown) could be provided to act on a moving portion of the exerciser 10, such as the intermediate sprocket 32.

While a preferred embodiment of the invention has been described using specific terms, such description is for illustrative purposes only, and it is to be understood that changes and variations may be made without departing from the spirit or scope of the following claims.

What is claimed is:

1. An exercise device for allowing a user supported thereon to practice simulated swimming motions for exercising muscles along the full length of the body comprising:

an "L" shaped frame having a base portion and vertically extending portion;

a vertically adjustable bracket carried on said vertically extending portion of said "L" shaped frame;

a foot pedal means rotatably mounted on said base portion of said "L" shaped frame for rotation by the feet of said user;

hand crank means rotatably mounted on said vertically adjustable bracket for rotation by said hands of said user;

said foot pedal means and hand crank means being laterally spaced apart from one another and cooperating together to provide the entire support of said user in a forwardly inclined, outwardly stretched position;

force transfer means in the form of a direct mechanical connection between said hand crank means and said foot crank means associated with said "L" shaped frame means for communicating motive force between said foot pedal means and said hand crank means; said force transfer means acting to position and continuously maintain said foot pedal means and said hand crank means substantially ninety degrees out-of-phase with one another, thereby allowing said user to experience a constant swimming-type motion when said user simultaneously operates both said foot pedal means and said hand crank means wherein the torque produced by the legs of the user is at a maximum when the torque produced by the hands of the user is at a minimum and vice versa;

means for providing a substantially uniform constant resistance to the forces created by the rotational motions of said foot pedal means and said hand crank means, means for adjusting the vertical postion of said hand crank means relative to said foot pedal means permitting a user to be fully extended in an inclined position with the hands being positioned well above the head so that said uniform constant resistance provides gentle uniform exercise to muscles throughout the length of the body.

2. An exercise device as set forth in claim 1, further comprising:

a viscous resistance tank means for providing a constant resistance to the forces created by the rotational motions of said foot pedal means and said hand crank means; and said force transfer means being interconnected to said viscous resistance tank means for communicating the forces created by the rotational motions of both said foot pedal means and said hand crank means to said viscous resistance tank means.

3. An exercise device as set forth in claim 2, wherein said viscous resistance tank means comprises:

a fluid-holding reservoir;

fluid carried in said fluid-holding reservoir;

a shaft mounted to rotate in said fluid-holding reservoir, said shaft being connected to said force transfer means;

propeller means fixed to said shaft for rotation with said shaft in said fluid-holding reservoir, said propeller means being in contact with said fluid carried in said fluid-holding reservoir; said fluid offering viscous resistance to the rotation of said propeller means.

4. An exercise device as set forth in claim 1, further comprising:

a horizontally extending handle means carried on said frame between said foot pedal means and said hand crank means; said handle means providing a place upon which said user may grab hold when said user is proceeding to mount or dismount said exerciser.

5. An exercise device as set forth in claim 1 wherein both said foot pedal means and said hand crank means are adjustable about said frame to allow for differing user heights.

6. An exercise device for allowing a user supported thereon to practice simulated swimming motions, comprising:

a frame;

foot pedal means rotatably mounted on said frame for rotation by the feet of said user;

hand crank means rotatably mounted on said frame for rotation by the hands of said user;

said foot pedal means and said hand crank means laterally spaced apart from one another for together providing the entire support of said user in a forwardly inclined, outwardly stretched position;

force transfer means associated with said frame means for communicating motive force between said foot pedal means and said hand crank means; said force transfer means acting to position and continuously maintain said foot pedal means and said hand crank means substantially ninety degrees out-of-phase with one another, thereby allowing said user to experience a constant swimming-type motion when said user simultaneously operates both said foot pedal means and said hand crank means;

intermediate drive means rotatably carried by said frame in rotatable communication with said force transfer means for rotatably outputting said motive force of said force transfer means;

a viscous resistance tank means for providing a constant resistance to the forces created by the rotational motions of said foot pedal means and said hand crank means, said viscous resistance tank means receiving the forces created by the motions of said foot pedal means and said hand crank means through communication with said intermediate means.

7. An exercise device as set forth in claim 6, wherein said viscous resistance tank means comprises:

a fluid-holding reservoir;

fluid carried in said fluid-holding reservoir;

a shaft mounted to rotate in said fluid-holding reservoir, said shaft being connected to said intermediate drive means;

propeller means fixed to said shaft for rotation with said shaft in said fluid-holding reservoir, said propeller means being in contact with said fluid carried in said fluid-holding reservoir; said fluid offering viscous resistance to the rotation of said propeller means.

8. An exercise device as set forth in claim 7 wherein said propeller means includes two propellers mounted coaxially on said shaft, each of said propellers being of opposite pitch with respect to the other propeller to increase the resistance experienced by said propeller means as it rotates in said fluid carried in said fluid-holding reservoir.

9. An exercise device as set forth in claim 7 wherein said fluid-holding reservoir includes baffles carried therein adjacent said propeller means for inhibiting inertia-building coincident motion of said fluid as said propeller means rotates in said fluid.

10. An exercise device for allowing a user supported thereon to practice simulated swimming motions, comprising:

a frame;

foot pedal means rotatably mounted on said frame for rotation by the feet of said user;

hand crank means rotatably mounted on said frame for rotation by the hands of said user;

said foot pedal means and said hand crank means laterally spaced apart from one another for together providing the entire support of said user in a forwardly inclined, outwardly stretched position;

force transfer means for communicating motive associated with said frame means force between said foot pedal means and said hand crank means, thereby allowing said user to experience a constant swimming-type motion when simultaneously operating both said foot pedal means and said hand crank means;

a viscous resistance tank means for providing a constant resistance to the forces created by the rotational motions of said foot pedal means and said hand crank means;

intermediate drive means rotatably carried by said frame in rotatable communication with said force transfer means for rotatably outputting said motive force of said force transfer means; and said intermediate drive means being interconnected to said viscous resistance tank means for communicating the forces created by the user-induced rotational motions of both said foot pedal means and said hand crank means from the force transfer means to said viscous resistance tank means.

* * * * *